US005871362A

United States Patent [19]

Campbell et al.

[11] Patent Number: 5,871,362

[45] Date of Patent: Feb. 16, 1999

[54] SELF-ALIGNING FLEXIBLE CIRCUIT CONNECTION

[75] Inventors: Jeffrey Scott Campbell, Binghamton; James Thomas Holton, Endwell, both of N.Y.

[73] Assignee: International Business Machines Corporation, Armonk, N.Y.

[21] Appl. No.: 798,411

[22] Filed: Feb. 7, 1997

Related U.S. Application Data

[62] Division of Ser. No. 364,473, Dec. 27, 1994.

[51] Int. Cl.[6] ..... H01R 9/09

[52] U.S. Cl. ..... 439/67; 439/74

[58] Field of Search ..... 439/67, 637, 74

[56] References Cited

U.S. PATENT DOCUMENTS

| | | | |
|---|---|---|---|
| 2,993,187 | 7/1961 | Bisbing et al. | 439/248 X |
| 3,924,915 | 12/1975 | Conrad . | |
| 4,131,933 | 12/1978 | Agard et al. . | |
| 4,439,000 | 3/1984 | Kaufman et al. . | |
| 4,587,596 | 5/1986 | Bunnell . | |
| 4,602,317 | 7/1986 | Rovnyak et al. . | |
| 4,655,524 | 4/1987 | Etzel . | |
| 4,693,529 | 9/1987 | Stillie . | |
| 4,768,971 | 9/1988 | Simpson | 439/67 X |
| 4,850,883 | 7/1989 | Kabadi . | |
| 4,853,830 | 8/1989 | Corfits et al. . | |
| 4,871,315 | 10/1989 | Noschese . | |
| 4,913,656 | 4/1990 | Gordon et al. . | |
| 4,934,942 | 6/1990 | Casciotti . | |
| 4,969,824 | 11/1990 | Casciotti . | |
| 5,067,908 | 11/1991 | Guth | 439/248 |
| 5,160,269 | 11/1992 | Fox, Jr. et al. | 439/67 |
| 5,171,154 | 12/1992 | Casciotti et al. . | |
| 5,197,888 | 3/1993 | Brodsky et al. . | |
| 5,199,881 | 4/1993 | Oshita et al. . | |
| 5,205,739 | 4/1993 | Malo et al. . | |
| 5,209,671 | 5/1993 | Sugimoto et al. . | |
| 5,211,577 | 5/1993 | Daugherty . | |
| 5,226,823 | 7/1993 | Johnson . | |
| 5,228,863 | 7/1993 | Campbell et al. . | |

FOREIGN PATENT DOCUMENTS

| | | |
|---|---|---|
| 0 297 573 | 1/1989 | European Pat. Off. . |

OTHER PUBLICATIONS

"High Density Field Replaceable Flexible Circuit Connector," IBM Technical Disclosure Bulletin, vol. 34, No. 3; Aug., 1991.

"Module–to–Board Hybrid Connector System," IBM Technical Disclosure Bulletin, vol. 32, No. 8A; Jan., 1990.

*Primary Examiner*—Steven L. Stephan
*Assistant Examiner*—T. C. Patel
*Attorney, Agent, or Firm*—Calfee, Halter & Griswold LLP

[57] ABSTRACT

The present invention provides an electrical connector assembly and method for connecting a flexible circuit to a substate with the contact pads of each in precise alignment. The connector assembly has at least one floating frame member which has first and second exposed surfaces. At least one fine or precise alignment pin extends from the first surface which is configured to mate with an alignment opening in the flexible circuit. A support member is provided which has a support surface which slidingly engages the second surface of the floating frame member to permit sliding movement thereon by the sliding frame member. A registration or coarse alignment pin is provided which is operatively associated with the floating frame member and the support member and configured to engage the substrate to roughly align but allow relative sliding movement of the floating frame member with respect to the substrate when the registration pin engages the substrate.

12 Claims, 7 Drawing Sheets

SELF-ALIGNING FLEXIBLE CIRCUIT CONNECTION

This is a divisional of copending application Ser. No. 08/364,473, filed Dec. 27, 1994.

FIELD OF THE INVENTION

This invention relates generally to high density pad-to-pad connectors utilizing flexible circuit for forming connections, and more particularly to a method and structure for forming precisely aligned connections in a pad-to-pad configuration with flexible circuit technology.

BACKGROUND

As the density of circuitry on cards and boards increases, thus increasing the density of connections necessary, the distance between adjacent pads as well as the size of the pads becomes smaller, thus requiring increasingly precise alignment of the connectors which contact the connecting pads. One of the present technologies used for making connections to pads on boards and cards is by utilizing flexible circuit with various flexible circuit mounting technologies. In certain instances, this precision can be accomplished by precise positioning during factory assembly of a single board to a single card or assembling flexible circuit precisely on a single card or a limited number of cards using alignment fixtures and the like.

However, for certain connection functions precise alignment is difficult to achieve. One instance where precise alignment is difficult to achieve in which high density pad-to-pad connections are required is in the "plugging in" of I/O cards on computers. In particular, I/O cards are inserted into I/O card slots provided for this purpose in computers, especially personal computers, wherein the I/O card joins with the planar or mother board. This is sometimes referred to as a card-to-board interconnection or daughter card to mother board interconnection. This type of card-to-board connection is called a "blind" connection since there is no eye or other instrument to "see" how the alignment of the pads is matching up. In such instance, the card is slid into the slot, and at the end of the slot, the connector pads on the mother board are connected by flexible circuit technology to connector pads on the daughter card. With conventional prior art practices of pin and hole connections (as opposed to flexible circuit technology), the connection would, to a great extent, be self-aligning in that the pins would physically plug into the holes. However, with present day technology utilizing pad-to-pad connection, i.e., connecting pads on flexible circuit in compressive engagement with pads formed on the mother board, there is no such "self-aligning" feature available. Hence, during the insertion process, alignment of the daughter card has to be maintained relatively precisely so that the proper pads on the flexible circuit which forms a portion of the connector properly align with the pads on the board to which connections are to be made. With relatively less dense array in which the pads are relatively larger, an appreciable amount of mismatch can be tolerated. However, miss alignment poses an ever increasing problem with the ever increasing density of pad connections without self-aligning features.

Other instances wherein precise alignment is difficult or tedious to achieve include those where a series of cards or family of cards is to be interconnected, e.g., in a parallel configuration, where the cards are to be connected serially back-to-front in adjacent positions. In these instances, precise alignment often can be obtained by hand by an operator precisely aligning the components. Nevertheless, it is time-consuming and, as the number of cards in the stack increase, the time necessary for precise alignment increases and the precise alignment becomes more difficult.

SUMMARY OF THE INVENTION

According to the present invention, an electrical connector assembly and method for connecting at least one end of a flexible circuit to a substrate with the contact pads of each in precise alignment is provided. The connector assembly has at least one floating frame member which has first and second exposed surfaces. At least one fine or precise alignment pin extends from the first surface and is configured to mate with an alignment opening in the flexible circuit. A support member is provided which has a support surface which slidingly engages the second surface of the floating frame member to permit sliding movement thereon by the sliding frame member. A registration or coarse alignment pin is provided which is operatively associated with the floating frame member and the support member and configured to engage the substrate to roughly align but allow relative sliding movement of the floating frame member with respect to the substrate when the registration pin engages the substrate.

DESCRIPTION OF THE PREFERRED EMBODIMENTS

Before turning to the description of the connectors and how they are utilized in conjunction with circuit boards according to this invention, it should be noted that the overall concept of the present invention is to provide a self-aligning feature for pad-to-pad connection of flexible circuit which is used in forming connections between connector pads on different substrates. Such connection includes connection between electrical pads on a circuit board and electrical pads on cards being connected thereto, or connections between the circuitry on opposite sides of circuit cards which are to be utilized in a stacked configuration. These are but two of the possible types of interconnections that can be used, it being understood that the present invention is useful for forming connections between the pads on the flexible circuit and the pads on some sort of substrate where precise alignment is required. The present invention provides for a self-aligning feature during connection or assembly to assure that there is proper precise alignment between the pads on the flexible circuit and the pads on the substrate being connected.

Figure 1:
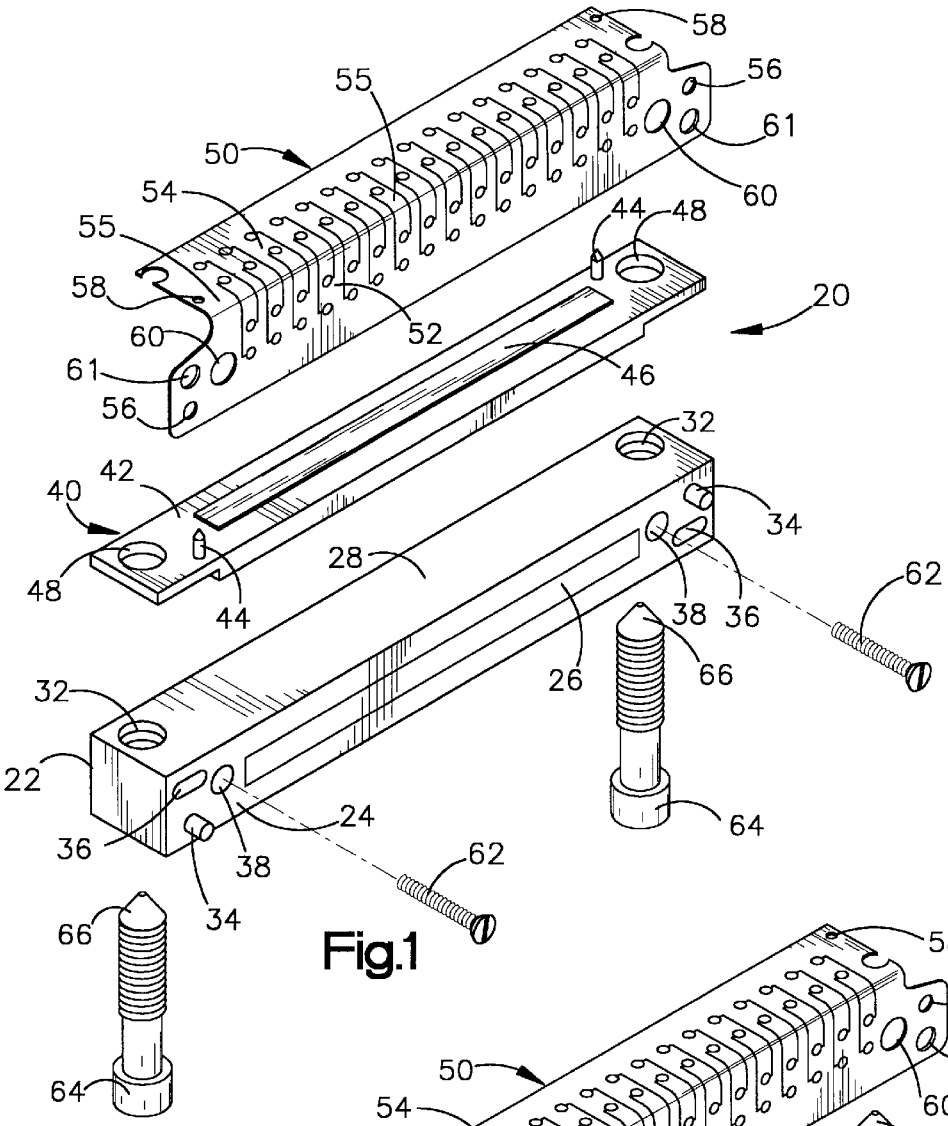
FIG. 1 is an exploded perspective view of one embodiment of a connector device adapted to connect a card to a circuit board using flexible connector technology according to this invention.
Figure 2:
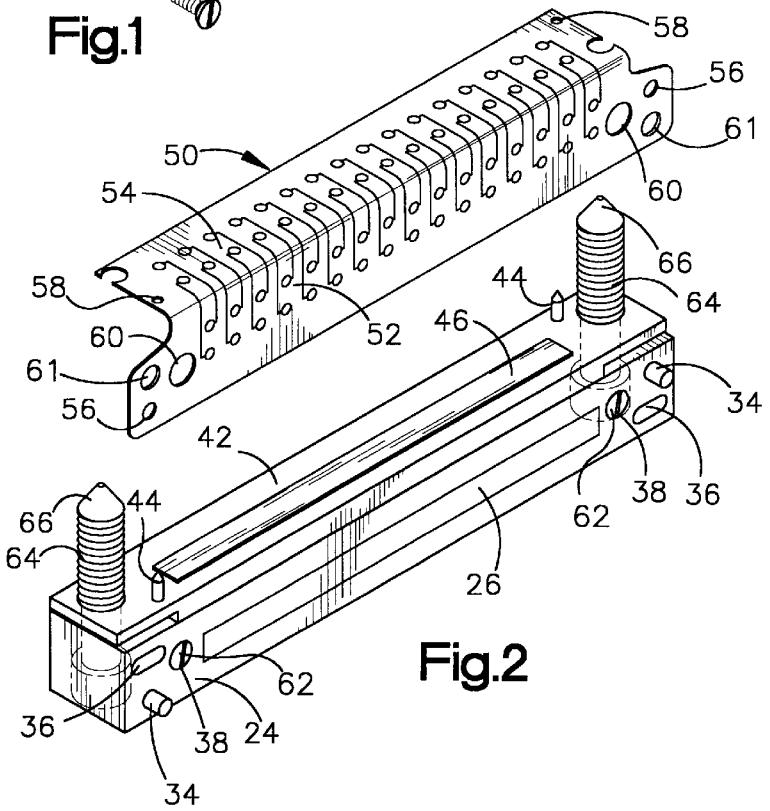
FIG. 2 is a perspective exploded view similar to FIG. 1 showing the device of FIG. 1 partially assembled.
Figure 3:
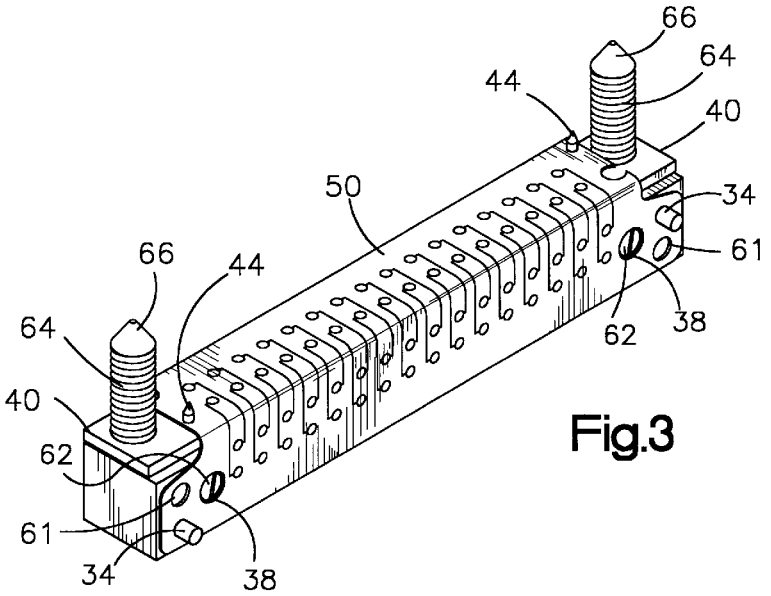
FIG. 3 is a perspective view of the device of FIGS. 1 and 2 in the assembled condition.

Referring now to FIGS. 1–3, one embodiment of a connector 20 formed according to the present invention is shown. The connector of this embodiment is especially useful and adapted to connect a card, such as a PC I/O card to a substrate, such as the planar board of a personal computer, wherein the card extends perpendicularly to the planar board. The connector 20 includes a generally rectilinear housing 22 which has a flexible circuit support surface 24 formed as one face thereof. An elastomeric pad 26 is bonded to the support surface 24. The housing 22 also includes a frame support surface 28 which is the face adjacent to and extending generally perpendicular with respect to the flexible circuit support surface 24. A pair of threaded openings 32 extend through the housing 22 and intersect the frame support surface 28. A pair of flexible circuit alignment pins 34 extend from opposite sides of the support surface 24 and a pair of pin-receiving slots 36 extend inwardly from the support surface 24. These are positioned to receive mating pins 34 from an adjacent connector 20 during assembly of the cards as will be described presently. The housing 22 also has threaded screw receiving openings 38 extending therethrough from the support surface 24.

A sliding or alignment frame 40 is provided which has a flexible circuit supporting surface 42 formed on one side thereof. Fine adjustment pins 44 extend upwardly on opposite sides of the flexible circuit support surface 42. An elastomeric pad 46 similar to the elastomeric pad 26 is bonded to the flexible surface support surface 42. The sliding frame 40 is provided with a pair of registration apertures 48 which extend therethrough and are positioned to be aligned with the threaded openings 32 of the housing 22.

A flexible circuit (sometimes referred to as flex circuit) member 50 is provided which has a first set of pads 52 and a second set of pads 54. The first and second sets of pads are connected by circuitry 55 in the form of conducting wires or traces. A first pair of alignment openings 56 are provided in the flexible circuit 50, which alignment openings are in a predetermined, precise alignment with respect to the first set of pads 52, and a second pair of alignment openings 58 are approved which are located in a precise alignment position with respect to the second set of pads 54. A pair of screw-receiving openings 60 is provided at opposite ends of the flexible circuit 50 adjacent to pads 52 in alignment with the threaded screw-receiving openings 38 on the flexible circuit 50. A pair of pin-receiving openings 61 is provided adjacent the openings 60 and positioned to receive pins 34 from a mating connector when the connectors are joined to engage a board as will be described presently. A pair of joining screws 62 are provided which serve to join two opposite connectors 20 engaging a card to form a card assembly as will be described presently.

A pair of threaded coarse alignment bolts 64 are provided which are adapted to threadably engage the threaded openings 32 in the housing 22 to mount and coarsely or roughly align the connector 20 when it is attached to a board as will be described presently. The coarse alignment bolts 64 have pointed tips 66, the purpose of which will be described presently.

Figure 4:
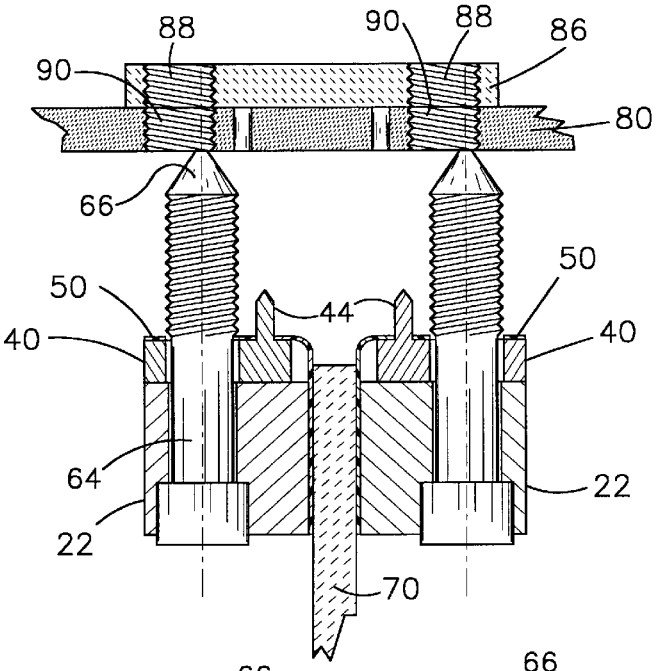
FIG. 4 is a perspective view showing four connector devices of FIGS. 1–3 connected to a card, and positioned to insert the card for connection to a circuit board.

Referring now to FIG. 4, a group of four connectors (three of which are shown) are used to connect the connectors 20 to a daughter card designated generally as 70 to form a card assembly. (The number of connections needed can vary depending upon their sizes and the size of the card 70.) The daughter card 70 has circuitry 72 on both sides thereof, the circuitry being provided with the necessary input pads 74 formed thereon. These pads 74 are positioned to align with pads 52 on flex circuit 50, of one of a respective connector 20 when the connector 20 is attached to the card 70.

The connectors are assembled such that there are two connectors 20 on each side of the card, each of the two connectors having an opposed connector 20 on the opposite side of the card. Each connector is first assembled as shown in FIG. 3, with the sliding frame 40 engaging the frame support surface 28 and freely movable thereon within the constraints of the pins 64. The flex circuit 50 for each connector is precisely registered with respect to the pads 54 thereon by pins 44 on the frame member 40 and the pads 52 precisely aligned by means of pins 34 on the surface 24 of the housing 22. When two opposing frames on opposite sides of the cards 70 are brought together on opposite sides, the pair of screws 62 are threaded through the threaded screw openings 38 in each housing 22. The pair of screws 62 extend through these openings 38, as well as through the openings 60 in the flexible circuit 50, and when drawn up tight cause compressive engagement of the pads 52 against the pads 74 on opposite sides of the card 70, thus assuring good contact. The elastomeric pad 26 assures good, uniform force. Precise alignment is obtained by means of the alignment pins 34 passing through openings in the card (not shown) and into the slots 36 on the connector on the opposite side of the card. This will precisely align the two connectors on opposite sides of the cards to each other and to the board. This is normally done as a factory operation, and hence the alignment can be readily achieved by an assembly. It is in the condition shown in FIG. 4 that the card assembly is in position to be connected to a circuit board 80.

The circuit board 80 includes a first set of pads 82 and a second set of pads 84, the pads 82 being positioned to engage the pads 54 on the two connectors on one side of the card, and the pads 84 being positioned to connect to the pads 54 on the connectors on the opposite side of the card 70. Further, it is to be understood that the board 80 in this environment is typically located at the end of a slot in a personal computer, and thus the card 70 with the connectors attached thereto must be slid into the slot and then secured to the board 80. The board 80 typically will have a stiffener 86 with threaded holes 88 therein, with the threaded holes being in alignment with mating threaded holes 90 formed in the board 80. The card 70 with the connector 20 oriented inwardly is slid into the slot or opening in the frame of the personal computer, and the threaded coarse alignment bolts 64 engage the holes 90 and holes 88 to cause the connection. The eight coarse alignment bolts 64 are then screwed down tight to cause engagement of the pads 54 on the various connectors 20 to engage the pads 82 and 84 on the board 80.

Figure 7:
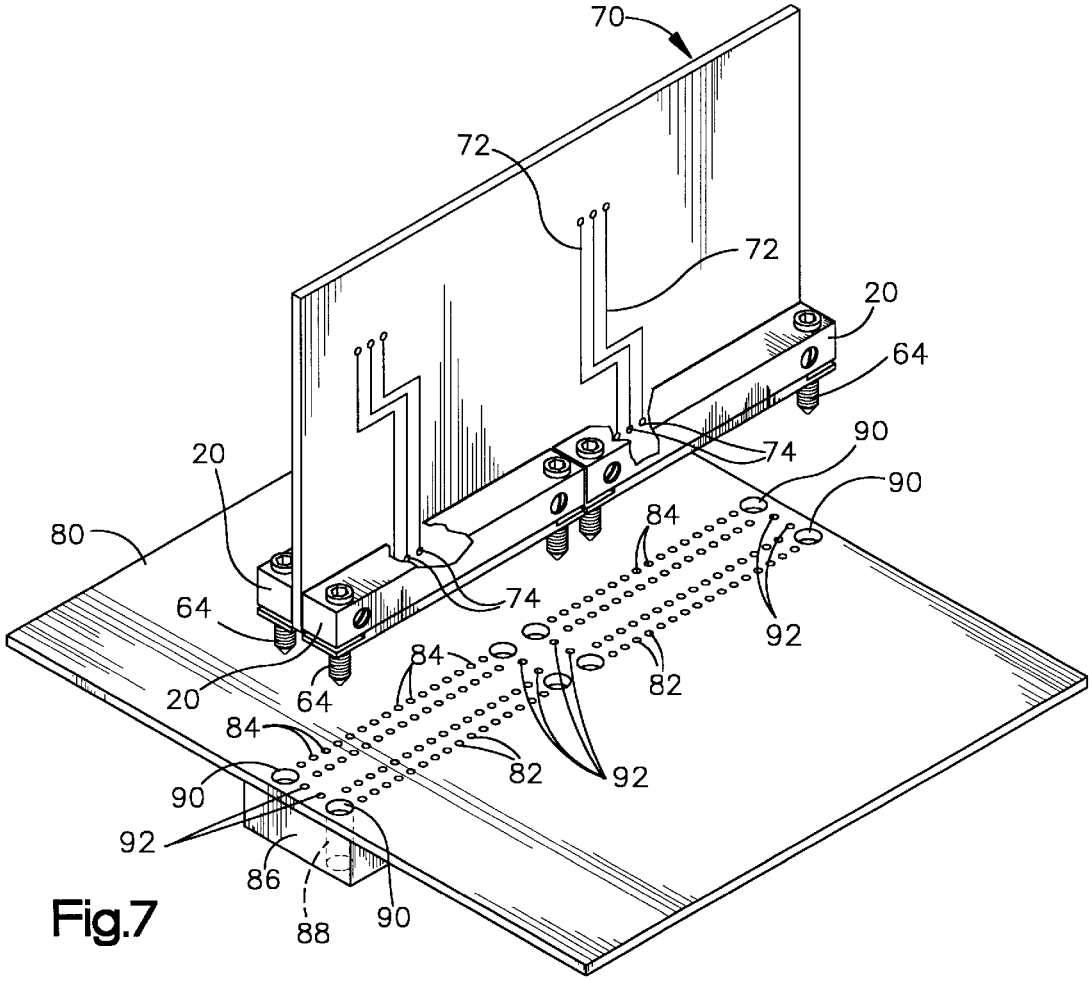
FIG. 7 is a view similar to FIGS. 4 and 5 showing the card completely inserted.
Figure 5:
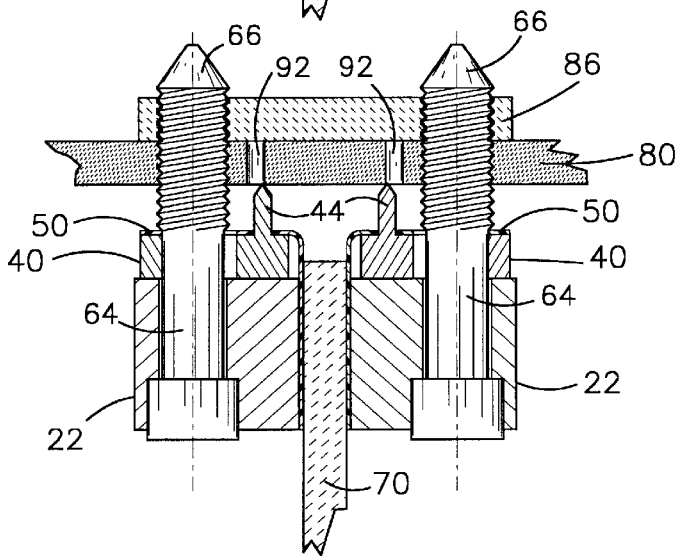
FIG. 5 is a detail sectional view of a portion of the connectors, card and board of FIG. 4 showing the initial positioning of the connector during insertion.
Figure 6:
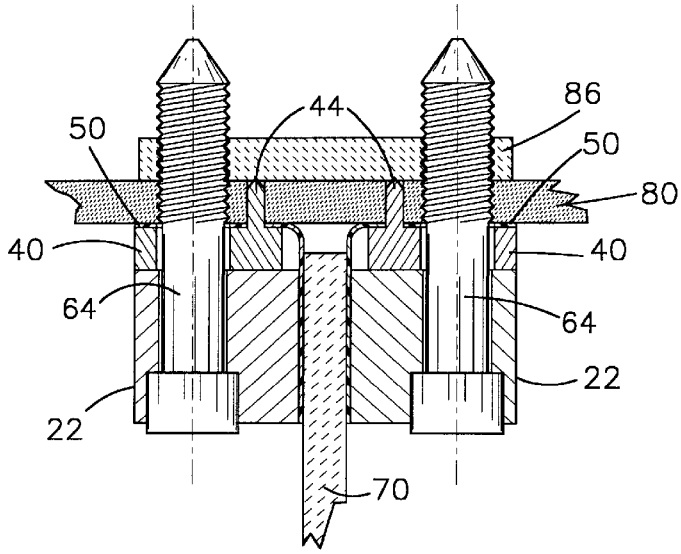
FIG. 6 is a view similar to FIG. 5 with the card partially inserted.

The self-aligning feature is shown somewhat diagrammatically in FIGS. 5–7 as the bolts 64 are tightened. As can be seen, the bolts are shown coming up from the bottom of the board 80, but it is immaterial whether they come from the top or the bottom, the determining factor being where the pads 82 and 84 are located. As shown in FIG. 5, the card 70 with the attached connectors 20 are pushed into whatever slot on the computer accommodates the card until the pointed ends 66 of the bolts 64, just engage the registration holes 90 in the board. As can be seen in FIG. 5, the alignment of the bolts 64 can be off significantly from the holes 90. This much misalignment, which can be ± as much as ±2.5 mm, cannot be tolerated. As the bolts are tightened, the pointed tips 66 of the bolts 64 are pushed by action of the surfaces of the holes 90, causing the entire assembly of card 70 and connectors 20 to move until the bolts 64 are in alignment with the holes 90, as the torquing or screwing of the bolts 64 draws the card 70 and associated connectors 20 toward the board 80, the bolts 64 and holes 90 providing a rough alignment of the pads 54 on each of the connectors 20 with the corresponding pads 82 and 84 on the board 80 as shown in FIG. 6. However, because of this relatively large size of the bolts 64 and holes 90 and with the use of threaded connections, this alignment is not precise, and, with fine geometry of modern technology, the alignment of the pads 54 and the pads 82 and 84 may be off enough to not afford a proper connection since the pads are typically spaced 50 mil center-to-center with the pads having a diameter of 25 mil.

As the bolts 64 are screwed down, the pins 44 of the sliding frame 40 which are also pointed come into engagement with the openings 92 in the board 80. At this point, the flex circuit 50 is not firmly engaged with the board 80 and thus is free to move. As shown in FIG. 6, when this engagement happens, the alignment of the pins 44 with the alignment openings 92 also may not be precise. However, with continued tightening of the bolts 64, the pins 44 will align themselves with the centers of the alignment openings 92. This alignment will cause the movement of the sliding frame 40 on the frame support surface 28 of the housing 22. The housing itself will not move since the bolts 64 being threaded into holes 90 firmly prevent the movement of the housing. However, since the registration apertures 48 in the sliding frame 40 are larger than the diameter of the coarse alignment bolts 64, the frame 40 has limited sliding movement available responsive to the interaction of the pins 44 and the alignment openings 42. Thus, as the bolts are torqued down, the sliding frame 40 will move the flexible circuit into a position where the pads 54 align precisely with the respective pads 82 or 84 on the board 80. This final position is shown in FIG. 7, with the contacts 52 on each flexible circuit 50 being precisely aligned and compressively engaged (due to the elastomeric pad 46) with the respective pads 82, 84 on board 80.

It should be noted that this final fine alignment performed by the pins 44 and the holes 92 is done by each connector 20; i.e., the sliding frames 40 on each of the connectors can move independently of the movement of the sliding frames 40 on any other connector, thus allowing each connector to precisely align its respective flexible circuit 50 with the pads 54 thereon with the mating pads 82 and 84 on the board 80. The elastomeric pad 46 provides the necessary resilient force to ensure a good connection. Thus, when the bolts 64 have been torqued down to their desired force, the card 70 is precisely placed on the board 80, this precise placement occurring even in a blind configuration where the card is inserted into a relatively long slot without the benefit of any sighting.

Thus, it can be seen that a connector using a short run of flex cable can be used to make pad-to-pad surface connections for mounting a card to a board, and this connection is possible even when the card is inserted in the slot for blind connection. Because of the construction, this invention allows for both coarse and fine registration or alignment of the pads with respect to each other.

Figures 8, 9:
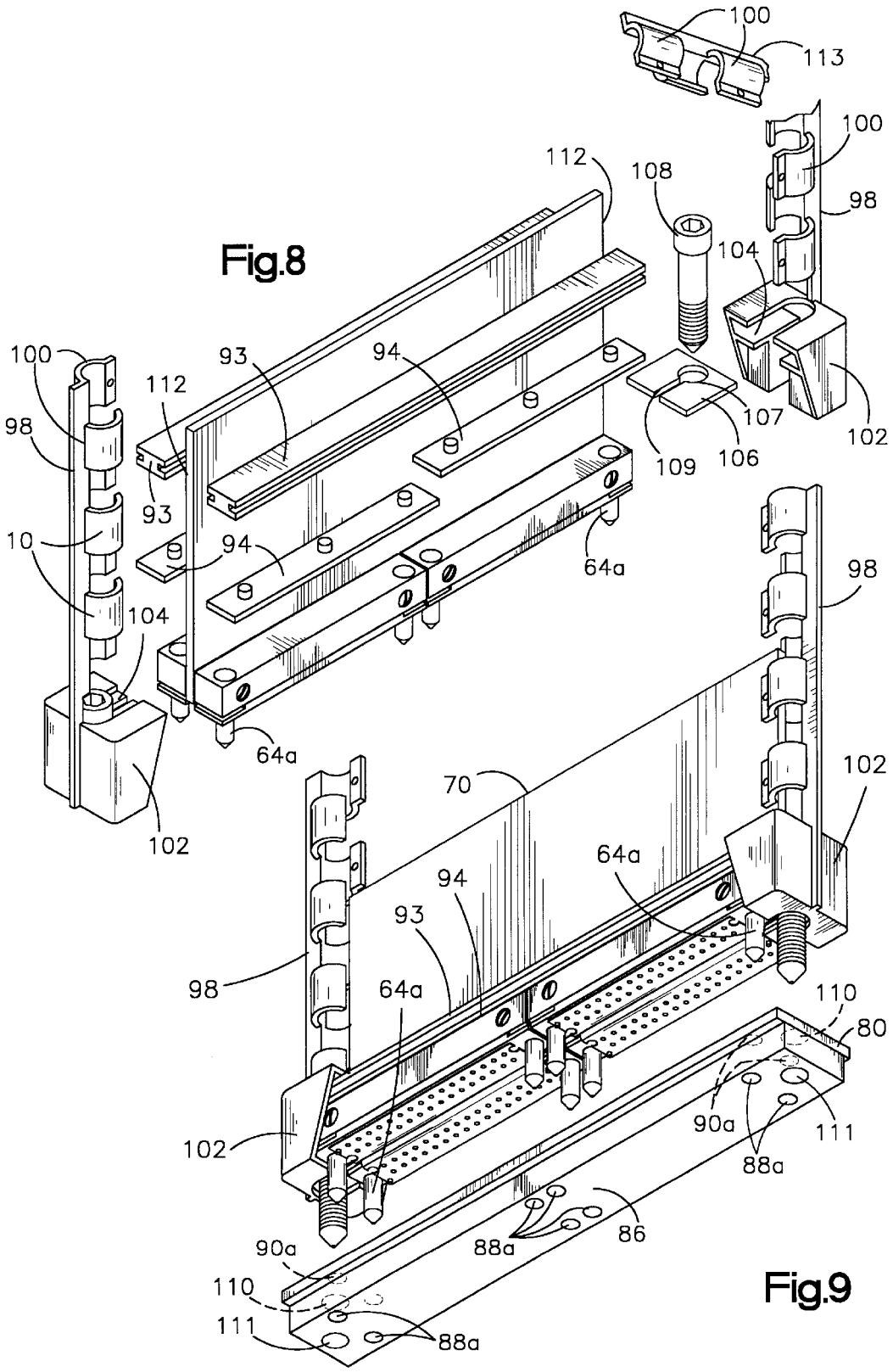
FIG. 8 is a perspective exploded view of another embodiment of a connector and card according to this invention, positioned for insertion onto a board.
FIG. 9 is a perspective view similar to FIG. 8 showing the card and tool alignment devices positioned to insert the card onto a circuit board.

Referring now to FIGS. 8 and 9, a configuration similar to that of FIGS. 1–7 is shown. In this embodiment, a guide is provided for a tool to allow tightening of the card onto the board and also a modified structure for mounting the card onto the board is provided. In this embodiment, all the elements of the connector 20 as previously described are the same, with the exception that the coarse alignment bolts 64 of the previous embodiment are replaced with unthreaded or smooth coarse alignment bolts 64*a*, and the openings 90 and 88 of the previous embodiment which were threaded are replaced with openings 90*a* and 88*a* which are smooth and unthreaded. Additionally, the card 70 has disposed on one surface thereof a stiffener bar 93 and elastomeric pads 94. In this embodiment, the card 70 is designed to be inserted into a cage, not shown. A pair of tool guides 98 are provided one on each side of the card 70, each of which has a plurality of "C" shaped sections 100 and terminates in a guide plate 102. The guide plates 102 each have a slot 104, which slot is configured to removably receive a clamp 106. Each clamp 106 has a central opening 107 through which a threaded actuation bolt 108 extends and a card engaging slot 109. The board 80 to which the card is being connected contains a pair of threaded openings 110, and the stiffener 86 contains threaded opening 111 positioned to receive the actuation bolt 108, as shown in FIG. 9. In this embodiment, the tool guides 98 engage the edges 112 of the card 70 with the connectors 20 secured thereon with its edges positioned in slots 109 of clamp 106 as shown in FIG. 9. This assembly is then inserted into a cage (not shown) and the actuation bolts 108 are aligned with the threaded openings 110 in the board 80. The tightening tool, which can be a long handle wrench or a screwdriver depending upon the head configuration of the actuation bolt 108, is inserted using the sections 100 as a guide, and the actuation bolts 108 are tightened. The unthreaded coarse alignment bolts 64 engage the smooth registration holes 90*a* and smooth openings 88*a* to provide the coarse alignment as in the previous embodiment. The slots 109 in clamp 106 are larger than the thickness of the card 70 and thus limited movement of the card assembly of the card 70 and connector 20 is permitted until the bolts 108 receive the connector 20 firmly to the card. As the actuation bolts 108 are tightened down on both sides, the fine alignment pins 44 coact with the openings 92 to provide the fine alignment just as previously described. The section guide may be left in place or, if desired, a notch 113 can be provided in the tool guide 98 between a pair of sections 100. The sections can be broken off after use so that they do not extend past the end of the slot.

Figure 10:
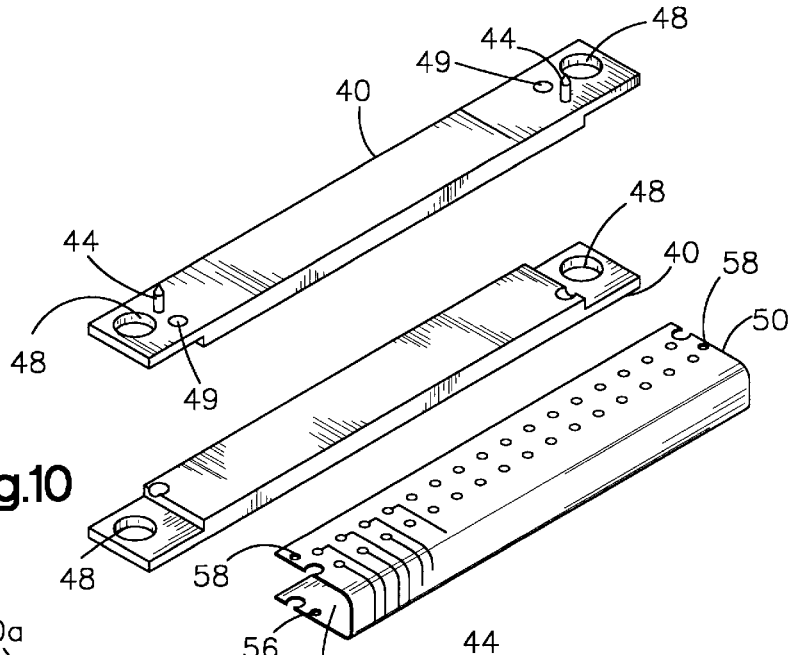
FIG. 10 is a perspective exploded view of yet another embodiment of the present invention utilizing a pair of sliding frame members for the interconnection of circuitry on opposite sides of cards.
Figure 11:
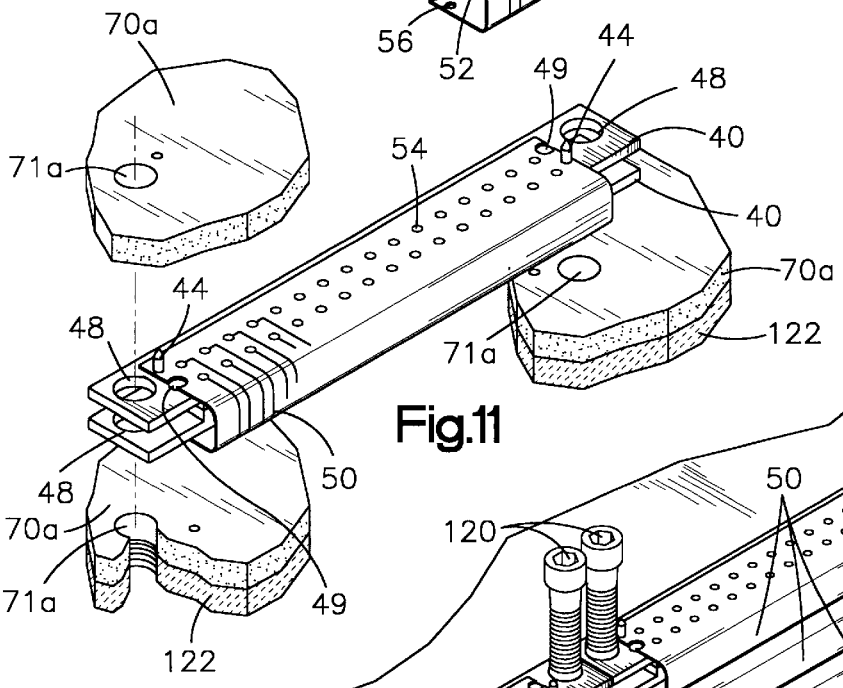
FIG. 11 is a view similar to FIG. 10 with the two sliding frames engaging a flexible circuit member.
Figure 12:
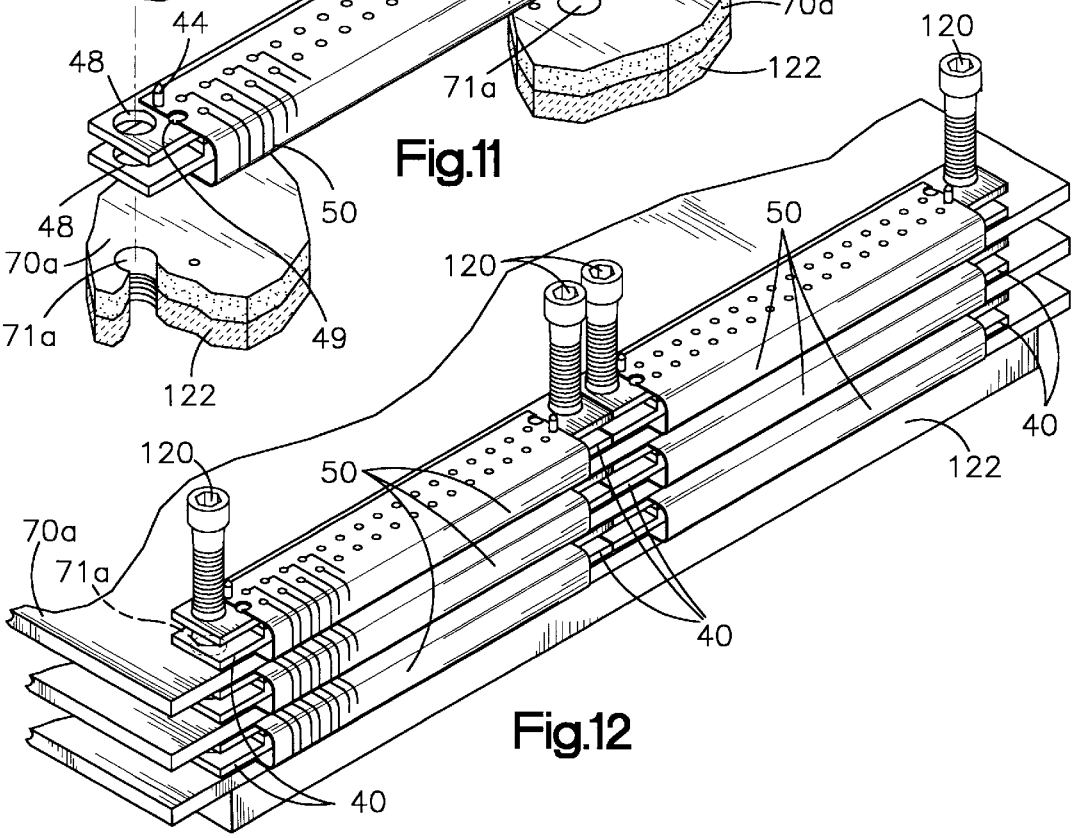
FIG. 12 is a perspective view of several connectors and boards as shown in FIG. 11 assembled to interconnect circuit cards.

Another embodiment of the connector using flexible circuit according to this invention is shown in FIGS. 10–12. This embodiment is adopted to connect two or more cards in a physically parallel stacked configuration by using connectors to connect the circuitry on the back side of one card to the circuitry on the front side or facing side of an adjacent card, using flexible circuit and pad-to-pad contact. In this embodiment, no separate housing member is utilized, but rather a pair of frame members 40 provides the support for each segment of flexible circuit 50. Two sliding frames 40 are arranged in a back-to-back configuration as shown in FIGS. 10 and 11. The frames 40 have the same construction as the frames shown in the previous embodiments. The flexible circuit 50 also has the same construction and is wrapped around the two back-to-back frames 40 as shown in FIG. 11, with the fine adjustment pins 44 of one of the sliding frames 40 engaging the alignment openings 58, in the flexible circuit 50 and the fine adjustment pins 44 of the other sliding frame 40 engaging the openings 56 in the other end of the flexible circuit 50. Thus, in this configuration, the connecting pads 52 and 54 are in opposed relationship, i.e., disposed on opposing surfaces and oriented 180° away from each other.

In this configuration, a series of cards 70*a* is provided, each of which has openings 71*a* therein. The cards 70*a* are aligned as shown in FIG. 12, and the connectors formed of the sliding frames 40 are interposed between each pair of cards as shown therein. Screws 120 pass through the opening 71*a* in the boards and engage a stiffener 122. The pins 44 of opposite or opposed sliding frames 40 engage holes (unnumbered) of substrate 70*a* in a manner similar to the pins 44 engaging holes 92 shown in FIGS. 4–6, and project toward surface 42 of the opposite frame 40, and when the screws 120 which provide the rough alignment are tightened, the pins 44 of each sliding frame 40 will align themselves in the holes 49 formed in the opposite sliding frame 40. The continued tightening of these screws 120 into the stiffener 122 will cause the precise alignment between the two floating frames 40 which oppose each other to thereby provide precise fine alignment of the pads 52 and 54 with the pads on the respective sides of the cards 70*a*. Thus, a series of cards 70*a* can be formed extending parallel to each other, and appropriate connection can be made to the card as desired through the flexible circuit 50 or through other pads on the board or through other means.

Figure 14:
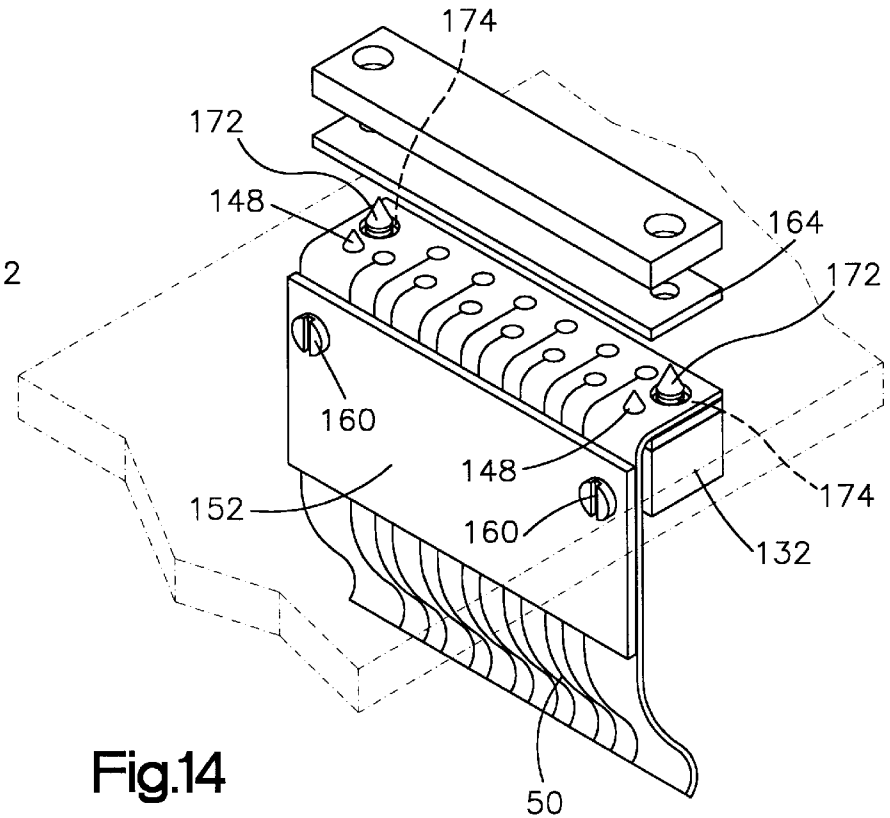
FIGS. 13 and 14 depict another embodiment of the present invention using a self adjusting and sliding frame member for both coarse and fine adjustments.
Figure 13:
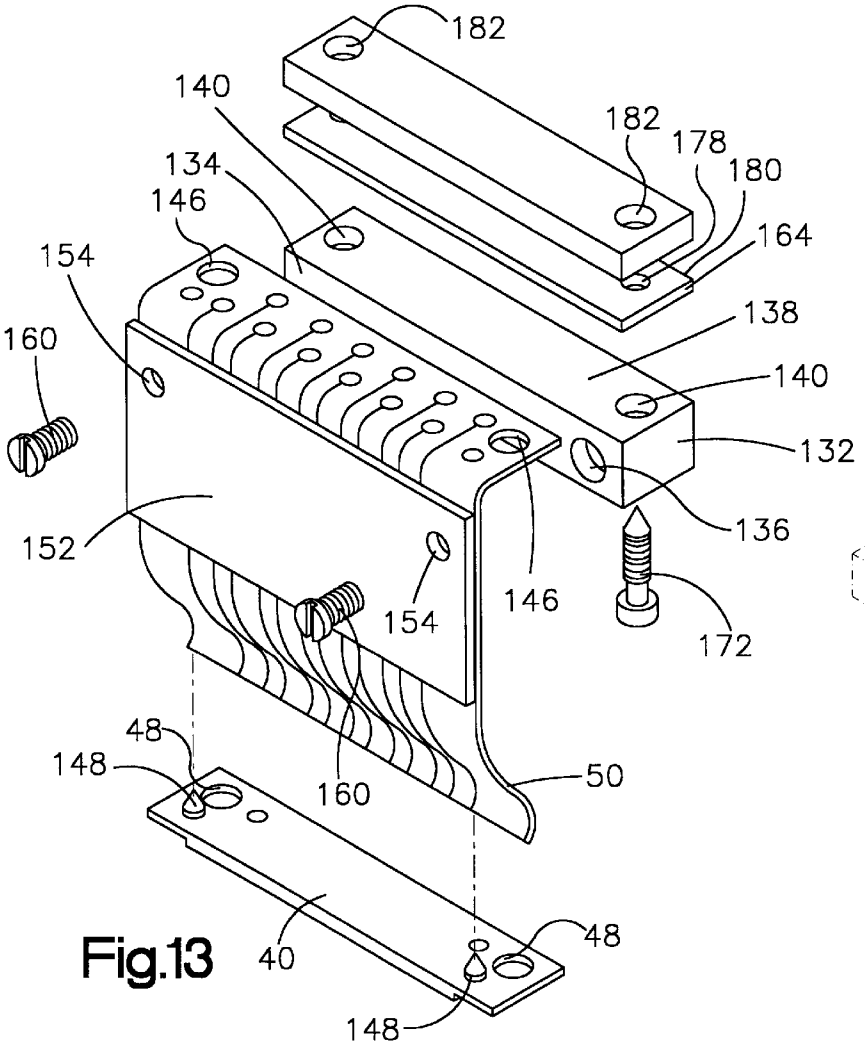

Referring now to FIGS. 13 and 14, another embodiment of the present invention using a self-adjusting and sliding frame member with both coarse and fine adjustments is shown in which the frame member is used as a connector for one end of flexible cable to a card or other similar structure with the cable itself acting as a connector to a remote location.

In this embodiment, a housing 132 is provided which has a cable support surface 134 as one face thereof. A pair of threaded openings 136 extend into the housing from the cable support surface 134. The housing 132 also has a frame support surface 138 which also has a pair of threaded openings 140 extending into the housing therefrom. The flexible cable 50 has a first pair of openings 146 and a second pair of openings 148. The pair of openings 146 are in alignment with the threaded openings 140. The openings 146 are also in alignment with the openings 48 in sliding frame 40 and the openings 148 are in alignment with the pins 44 of the sliding frame 40.

In this embodiment, the cable 50 is provided with a cable stiffener 152, which has a pair of openings 154 therein which align with openings (not shown) in the cable 50. A pair of screws 160 are provided which secure the cable.50 and the cable stiffener 152 to the frame member 132 by passing through the openings 154 and openings in the cable and then threadably engaging the threaded openings 136 and the housing 132. The cable 160 is engaged by the sliding frame 40 in a manner similar to that described in previous embodiments, with the fine alignment pins 44 passing through the openings 148 in the flexible cable 50.

The cable is connected to a board as shown in FIG. 2A or card 170 as shown in broken outline in FIG. 14. The connection is made by a pair of threaded bolts 172 threadably engaging the pair of openings 140 in the housing 132 and also threadably engaging threaded openings 174 of card 170 and threaded openings 178 in elastomer insert 180 and threaded openings 182 in card stiffener 184. When the threaded bolts 172 are tightened with the card 170 in place as shown in FIG. 14, the alignment action will be as described with respect to the previous embodiments and specifically with respect to FIGS. 4–6, with the bolts 172 providing for the coarse or rough alignment, and the fine alignment pins 44 moving the sliding frame 40 with the flexible circuit 50 mounted thereon to precise or fine alignment with the card for engagement of contacts on the flexible circuit 50 with contacts on card 172. The opposite end of the cable can then be connected in any manner to connectors at any remote location.

Figure 17:
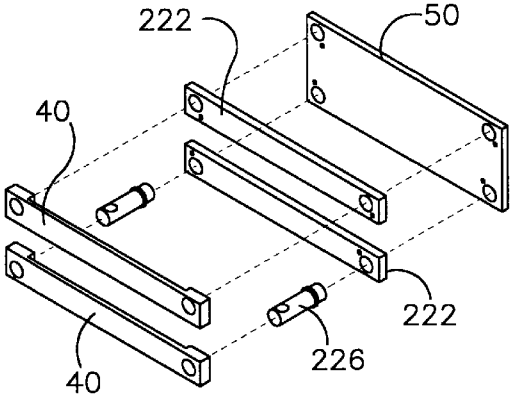
FIGS. 15–17 depict another embodiment of the invention before connecting a card to a motherboard.
Figure 16:
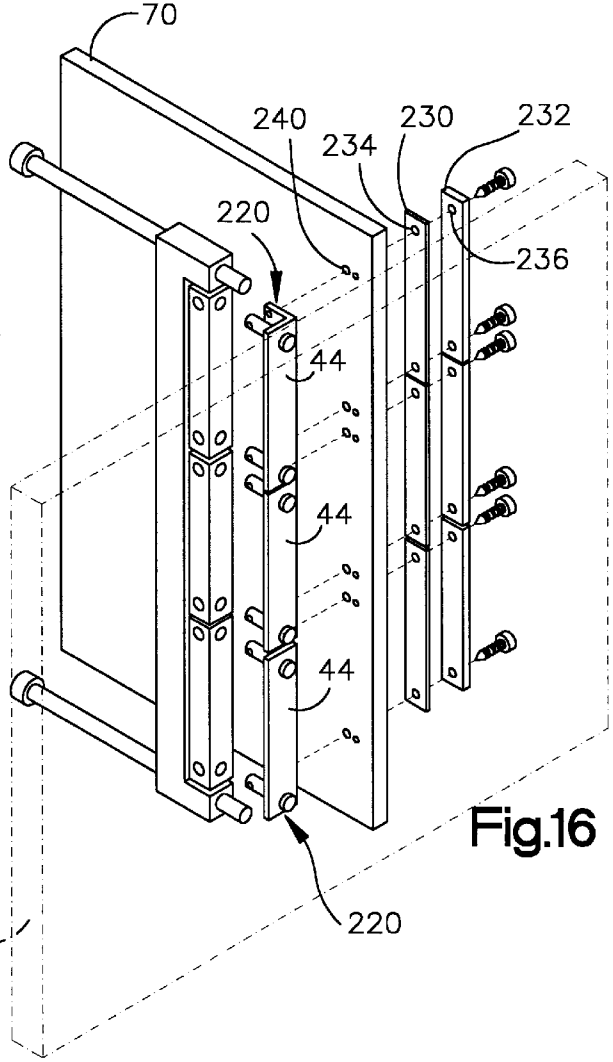
Figure 15:
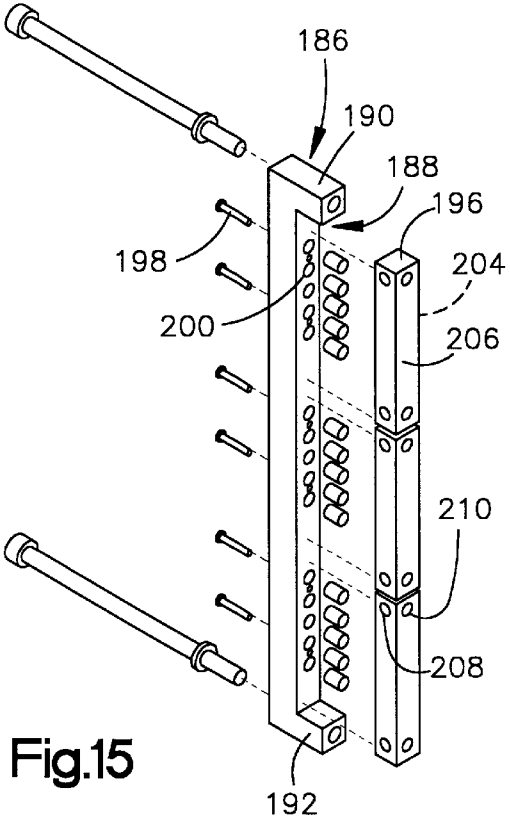

Referring now to FIGS. 15–17, another embodiment of the invention is shown which is particularly useful in connecting a card to a mother board similar to the type of connection shown in FIG. 7 of card 70 to board 80. Since many of the parts of this assembly are similar to that shown in FIG. 7, certain of them are omitted for clarity of illustration.

In this embodiment, an actuating assembly is provided which includes a yoke 186 which has an opening 188 between the opposite legs 190 and 192 of the yoke. The opening 188 is for the reception of one or more housings 196. The housings 196 are disposed in the opening 186 and mounted therein by screws 198 passing through openings 200 and the yoke 186 and threadably engaged into screw openings (not shown) in the housings 196. Springs 202 are interposed between the housings 196 and the frame of the yoke 190.

The housings 196 each have a pair of frame mounting surfaces 204 and 206 disposed at right angles with respect to each other. The surface 204 has openings 208 extending therethrough and the surface 206 has openings 210 extending therethrough. The frames 196 are disposed in the openings 188 of the yoke 186 and are positioned for the reception of a sliding frame unit 220 as shown in FIG. 16.

The materials for constructing a sliding frame unit and how they are assembled are shown in exploded view in FIG. 17. These include a pair of frame members 40 which are shown in the embodiment of FIGS. 10–12. Adhesive films 222 are provided which bond flexible circuit 50 to the frame members 40.

The flexible frame members 40 with the flexible circuit 50 bonded thereto are folded to the configuration as shown in FIG. 16 and secured to the housing 196 in the following manner. Alignment pins 226 are provided which extend through the openings 48 in one of the frame members 40 and extend into the openings 210 of the housing 196. The alignment pins 226 each have through bores 228 for a purpose which will be described presently. The board 70 is attached to the other sliding frame member unit 220 by use of insulators 230 and stiffeners 232 which have openings 234 and 236 respectively. Threaded screws 238 pass through the openings 232 and 234 and threadably engage openings 240 in board 70 and then pass through the openings 48 in the frame 40 which is adjacent to board 70 and into the openings 208 of the housings 196 and through the transverse bores 228 in the alignment pins 226. This will secure the card 70 to the unit 220 which in turn will be secured to the housing 196 and the yoke 186.

The unit with the card 70 attached is then attached to the mother board 80 by means of elongated threaded screws 240 which pass through the legs 190 and 192 of the yoke 188 and thread into openings (not shown) in the mother board 80. Thus, the mounting of the card 70 to the mother board 80 is similar to that as shown in FIG. 7, but with coarse and fine alignments being performed by the two sliding frame members 40 of the sliding frame unit 220, one of the sliding frame members 40 aligning the flexible circuit 50 with the contacts on the card 70 and the other of the frames 40 aligning the contacts on the flexible circuit 50 with the system or mother board 80.

Accordingly, the preferred embodiments of the present invention have been described. With the foregoing description in mind, however, it is understood that this description is made only by way of example, that the invention is not limited to the particular embodiments described herein, and that various rearrangements, modifications, and substitutions may be implemented without departing from the scope of the invention as hereinafter claimed.

What is claimed is:

1. An electrical connector assembly connecting at least one end of a flexible circuit having electrical contact pads thereon to a substrate, which substrate has electrical pads for contacting the pads on said flexible circuit, said flexible circuit having a plurality alignment openings, comprising, a floating frame member having a flexible circuit engaging surface, a plurality of alignment pins extending from said flexible circuit engaging surface and engaging said alignment openings in said flexible circuit, a support member, said support member having a support surface slidingly engaging said floating frame member to permit sliding movement thereon by said floating frame member, said support member including a plurality of registration openings said substrate having;

a) alignment holes formed therein; and b) registration holes formed therein;

a plurality of registration pins engaged with said support member through said registration openings and engaging said substrate in said registration holes to allow relative sliding movement of said support member with respect to said substrate when the registration pins engage said substrate, and said alignment pins engaging said alignment holes in said substrate, whereby said registration pins provide coarse alignment and said alignment pins provide fine alignment of the pads on the flexible circuit with the contacts on the substrate.

2. The invention as defined in claim 1 wherein a separate actuation mechanism is provided including a clamping structure operable against said support member to urge said support member toward said substrate.

3. The invention as defined in claim 2 wherein said actuation mechanism includes a bar member contacting said support member, and a screw actuated clamp device operable against said bar member.

4. The invention as defined in claim 3 wherein a guide device guides said screw actuating said clamp device.

5. The invention as defined in claim 1 wherein said connector assembly includes first and second support members each mounting a floating frame member with an independent flexible circuit mounted thereon secured to said substrate.

6. The invention as defined in claim 1 wherein there are first and second floating frame members, and said second floating frame member is slidably mounted on said first floating frame member and has a flexible circuit support surface oriented oppositely from said flexible circuit support surface of said first floating frame member with a plurality of second alignment pins extending therefrom, and wherein said flexible circuit has a second set of alignment openings, and said flexible circuit is wrapped around said first and second floating frame members with the respective second alignment pins engaging the second set of alignment openings, and wherein said flexible circuit has a second set of contact pads in engagement with a set of electrical pads on a second substrate, and wherein said second substrate is oriented essentially parallel to said first substrate.

7. The invention as defined in claim 6 wherein said second substrate has registration openings, and said registration pins are common to said first and second registration openings and are disposed therein.

8. The invention as defined in claim 1 wherein said support member includes a second flexible circuit engaging surface and second alignment pins formed thereon engaging said second openings in said flexible circuit.

9. The invention as defined in claim 8 wherein said support frame is a second floating frame member.

10. The invention as defined in claim 8 wherein said second flexible circuit engaging surface is oriented generally perpendicular to said first flexible circuit engaging surface.

11. The invention as defined in claim 1 wherein the registration pins include threaded members for threadably engaging said circuit board to thereby urge pads on said flexible circuit into engagement with pads on said substrate.

12. The invention as defined in claim 1 wherein said floating frame member includes at least one registration aperture aligned with at least one of said registration pins and positioned to roughly align said floating frame member with respect to the support frame.

* * * * *